United States Patent [19]

Meershoek et al.

[11] Patent Number: 4,786,838

[45] Date of Patent: Nov. 22, 1988

[54] ELECTROMAGNETIC DEFLECTION UNIT DIRECTLY WOUND ON A SUPPORT

[75] Inventors: Hans Meershoek; Antonius H. Van Tiel, both of Eindhoven, Netherlands

[73] Assignee: U.S. Philips Corporation, New York, N.Y.

[21] Appl. No.: 53,984

[22] Filed: May 26, 1987

[30] Foreign Application Priority Data

Jun. 10, 1986 [NL] Netherlands ..... 8601501

[51] Int. Cl.[4] ..... H01J 29/70; H01F 5/05

[52] U.S. Cl. ..... 313/440; 315/399; 335/213; 358/248

[58] Field of Search ..... 313/440; 358/248, 249; 335/213, 214, 299; 315/364, 399

[56] References Cited

U.S. PATENT DOCUMENTS 2,713,131 7/1955 Urtel ..... 313/440 X
4,359,705 11/1982 Bohn et al. ..... 335/213
4,713,641 12/1987 Osseyran et al. ..... 335/213

*Primary Examiner*—David K. Moore
*Assistant Examiner*—K. Wieder
*Attorney, Agent, or Firm*—Thomas A. Briody; Leroy Eason

[57] ABSTRACT

A cathode ray tube electromagnetic deflection unit comprising a support (4) having a flange (8) at its constricted end (5) which has a tangential groove into which radial grooves (14) merge. Two sets of deflection coils (18, 19) are wound on the support (4), the turns thereof running through the radial grooves (14) and the turns of one set bending into the tangential groove. The coils of the coil system 18 are for line deflection, and the two halves thereof are wound in the opposite winding sense and are energized during operation in such a manner that the highest voltage in both coils occurs at the coil turns adjacent plane of separation between the two coils and the lowest voltage occurs at the coil turns most remote from such plane of separation.

3 Claims, 3 Drawing Sheets

ELECTROMAGNETIC DEFLECTION UNIT DIRECTLY WOUND ON A SUPPORT

BACKGROUND OF THE INVENTION

1. Field of the Invention

The invention relates to an electromagnetic deflection unit for a cathode ray tube, comprising:

a hollow, annular support having a constricted and a wide end and a longitudinal axis;

a flange at the constricted and the wide end, respectively, of the support, each flange having at least one tangential groove with a bottom and each having a multitude of substantially radial grooves merging into a said tangential groove;

a first set of deflection coils for line deflection of an electron beam in a first direction at right angles to the longitudinal axis, which deflection coils are directly wound on the inside of the support and whose turns each run through the tangential groove and through radial grooves in the flanges; and a second set of deflection coils for field deflection of an electron beam in a direction at right angles to the longitudinal axis and at right angles to the first direction, which deflection coils are directly wound on the support and whose turns run through radial grooves in the flanges.

2. Description of the Related Art

A deflection unit of this type is known from European Pat. No. 0,102,658A1 (PHN 10416) which corresponds to U.S. Pat. No. 4,484,166, issued Nov. 20, 1984.

Cathode ray tubes have a neck-shaped portion one end of which accommodates an electron gun and the other end of which merges into a tapered portion with a screen contiguous to it. An electromagnetic deflection unit surrounds the neck-shaped portion and rests against the tapered portion or is positioned at a short distance therefrom. In the case of a colour display tube this deflection unit must be capable of deflecting the electron beams to the corners of the screen while maintaining convergence. This means that both the horizontal deflection field and the vertical deflection field must have a very special distribution. To realize this, the known deflection unit is provided between its ends with an annular body having guide grooves in the inner circumference accommodating the longitudinal segments of the coil turns. This provides a possibility of controlling the wire distribution (and hence the field distribution): the choice is not restricted to wires running straight from front to back but they may alternatively run in a bend via the grooves in the intermediate ring. The wire location of a coil can therefore be freely modulated as a function of the direction along the longitudinal axis in the direction of the corners and a self-converging deflection coil system can be realized.

Since both the wires of the line deflection coil and the field deflection coil are guided on the inside of the intermediate ring and are thus positioned close together, there is a risk of ringing occurring between the line deflection coil and the field deflection coil.

Since a limited number of grooves can be provided in the inner circumference of the said ring, there may be a number of grooves, dependent on the coil design, accommodating longitudinal turn segments of both the line deflection coil and of the field deflection coil. During winding, for example, the field deflection coil turns are accommodated in these grooves first and then the line deflection coil turns are accommodated. In addition to the risk of ringing there is also the risk of high voltage breakdown between the line and field deflection coils.

SUMMARY OF THE INVENTION

It is an object of the invention to provide a deflection unit having a construction reducing the risk of ringing and the risk of high voltage breakdown between the line and field deflection coils.

In a deflection unit according to the invention this object is realized in that the two halves of the first set of deflection coils, viewed in a flared-out form, are wound in the opposite winding sense and are connected during operation to an energizing voltage in such a manner that the potential distribution in both coils is such that the highest potential is on the coil turns adjacent the plane of separation between the coils and the lowest potential is on the coil turns most remote from such plane of separation.

A preferred embodiment of the deflection unit according to the invention is characterized in that the longitudinal turn portions of the coils of the second system of coils are remote from the plane of separation between the coils of the first system of coils. The following advantages are achieved thereby:

For the two line deflection coil halves the high voltage of the line deflection coil is in a position which is not opposite a field deflection coil.

If the line and field deflection coils are not separated by a separate isolator, this configuration has the advantage that the wire insulation can be dimensioned for a lower voltage than the total flyback voltage.

The capacitive currents from the line coil to the field deflection coil will be lower because the voltage between the line and the field deflection coils is lower. This reduces the intensity of any ringing.

The annular support of the deflection unit according to the invention may be a synthetic material body having synthetic material flanges in which or around which a yoke ring of a soft magnetic material is provided. On the other hand a yoke ring itself may be the support whose constricted and wide ends are connected to a synthetic material flange. Both sets of deflection coils may be of the saddle type, or one set may be of the saddle type and one set may be of the toroidal type. The flange at the constricted end may have a transversal groove for each of the sets of deflection coils, or one groove for the two sets combined, or more than two transversal grooves such as, for example, one for one set of deflection coils and two for the other set, or one for each separate set and one for the two sets combined.

BRIEF DESCRIPTION OF THE DRAWING

An embodiment of a deflection unit according to the invention is shown in the drawings, in which.

DESCRIPTION OF THE PREFERRED EMBODIMENTS

Figure 1:
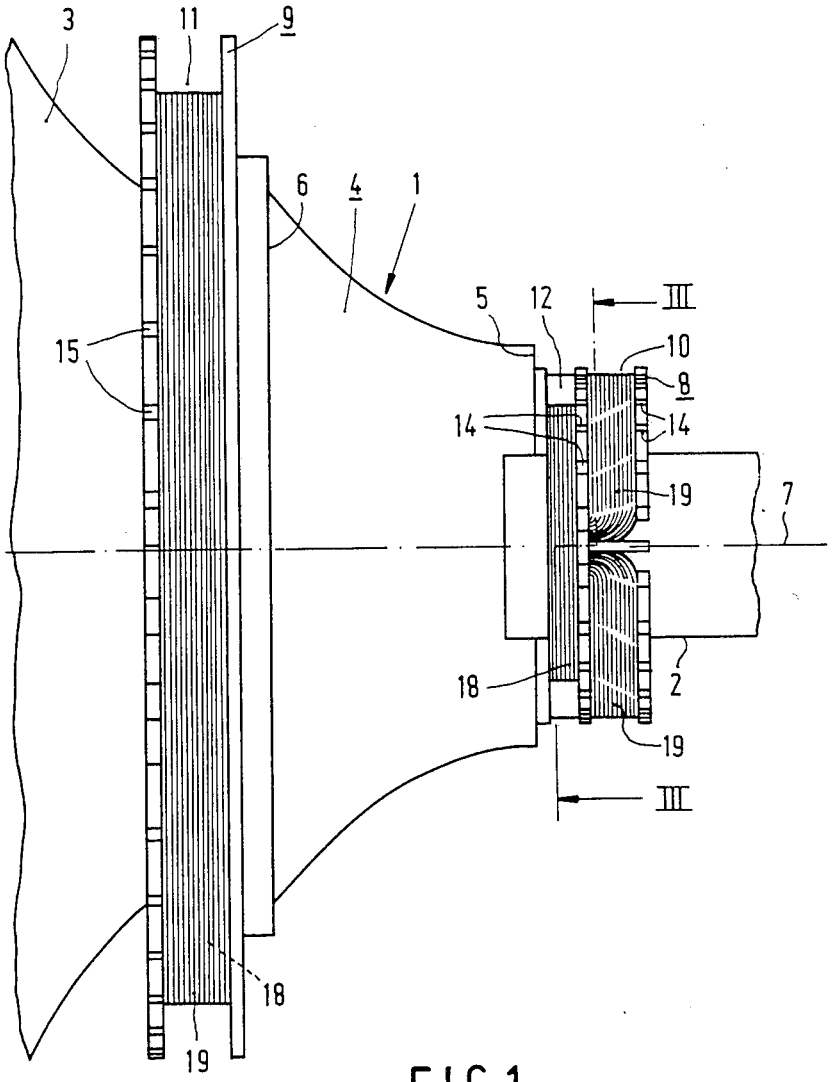
FIG. 1 is a side view of a deflection unit placed around the neck-shaped portion of a cathode ray tube.

In FIG. 1 the electromagnetic deflection unit 1 is placed around the neck-shaped portion 2 of a cathode ray tube whose tapered portion is denoted by the reference numeral 3. The deflection unit 1 has a hollow, annular support 4 having a constricted and a wide end 5 and 6, respectively, and a longitudinal axis 7. In the Figure the support 4 is a yoke ring of a soft magnetic material. The support 4 has flanges 8 and 9 of transparent polycarbonate at the constricted end 5 and the wide end 6, respectively. The flanges 8, 9 each have at least one tangential groove 10, 11 with a bottom and multitude of substantially radial grooves 14, 15 merging into the tangential grooves 10, 11. In the Figure the flange 8 has a second tangential groove 12. In the flange 8, at the constricted end 5, the radial grooves 14 have a longitudinally extending portion with a width and a depth, which longitudinally extending portions are tangent to an inscribed circle.

A first set of deflection coils 18 for line deflection of an electron beam in a first direction at right angles to the longitudinal axis 7 (that is to say: in the plane of the drawing) is directly wound on the inside of the support 4. The turns of the set of coils 18 each run through the tangential grooves 12 and 11 of the flanges 8 and 9, respectively and through their radial grooves 14 and 15, respectively.

A second set of deflection coils 19 for field deflection of an electron beam in a direction at right angles to the longitudinal axis 7 and at right angles to the first direction (that is to say: at right angles to the plane of the drawing) is also directly wound on the support and its turns run through radial grooves 14, 15 in the flanges 8, 9. In the Figure the two sets of deflection coils 18, 19 are of the saddle type. Also the second set of deflection coils 19 is wound on the inside of the support 4 and its turns also run through tangential grooves 10 and 11 in the flanges 8 and 9, respectively. The first set of deflection coils 18 is wound first. In an intermediate ring 20 (FIG. 2) its turns partly run in the same grooves as the turns of the second set of deflection coils 19 and hence under the turns of the second set 19. In flange 8 the turns of the first set 18 and the second set of deflection coils 19 have their own tangential grooves 12 and 10, respectively. The deflection unit of FIG. 1 has the characteristics of the deflection unit according to the invention. These characteristics are explained with reference to FIGS. 2, 3, 4 and 5. Components shown in FIG. 1 have the same reference numerals in these Figures.

Figure 2:
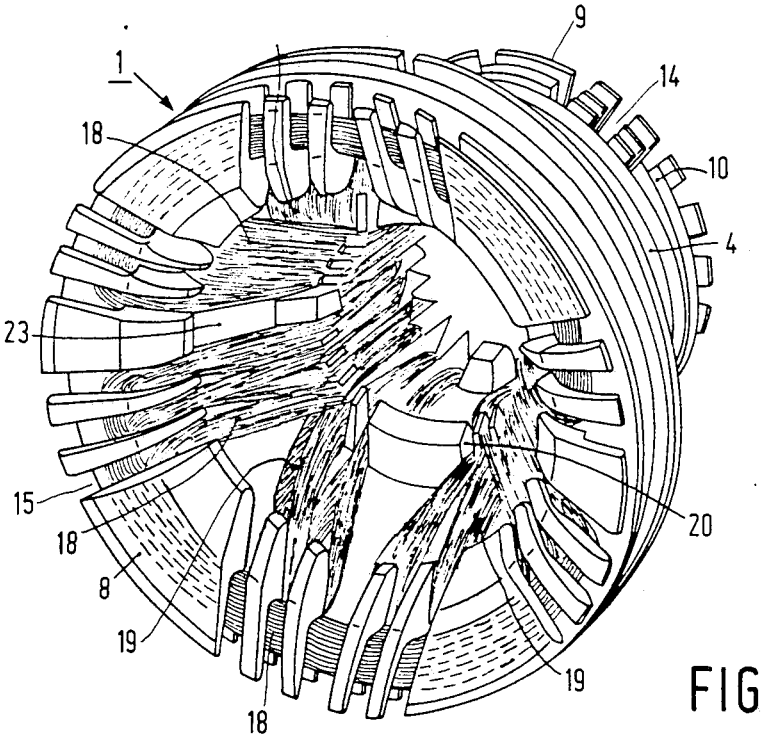
FIG. 2 is a perspective elevational view of the deflection unit of FIG. 1.

FIG. 2 shows an intermediate ring 20 whose inside is provided with a plurality of grooves. A front view of intermediate ring 20 (FIG. 3) shows a substantially non-radial variation of the grooves 21 , 21', 21" etc. Between the flanges 8 and 9 the wires of the coils run through the grooves 21, 21', 21" . . . on the inside of the intermediate ring 20 (FIG. 5) so that not only the wires run free from the inner surface of the support 4 but also the parts of the wires from the one to the other end of the deflection coil support 4 run in different planes (the paths of the wires have a "kink").

Figure 3:
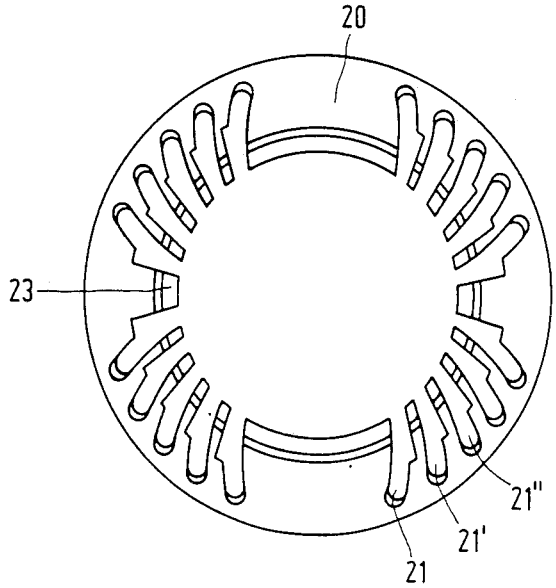
FIG. 3 shows an annular component of the deflection unit of FIG. 1.

With reference to FIG. 3 it is to be noted that the grooves 21, 21', 21" . . . which are provided on the inner circumference of ring 20 have a variation which corresponds to the direction of the wire supplied during the winding process. Since, as already noted hereinbefore, a number of wires does not extend straight from the front to the rear of the coil support, but with a kink, the direction of the axis of the grooves 21, 21', 21" . . . differs from the radial direction. FIG. 3 also shows that such a groove must extend in two different directions when the wires of coils of two different sets of coils must be passed through one groove.

If the line coil halves with the reverse winding sence are paired to parallel arranged combinations, it can be achieved that there is only a low voltage between the parts of the coil halves which are located close together if at least the connection of the parallel arranged coil halves is connected to the highest voltage of the energizing device, which connection corresponds to the wires of the parts of the coil halves which are closest together. This is further illustrated in FIGS. 4*a*, 4*b* and 5.

Figure 4A:
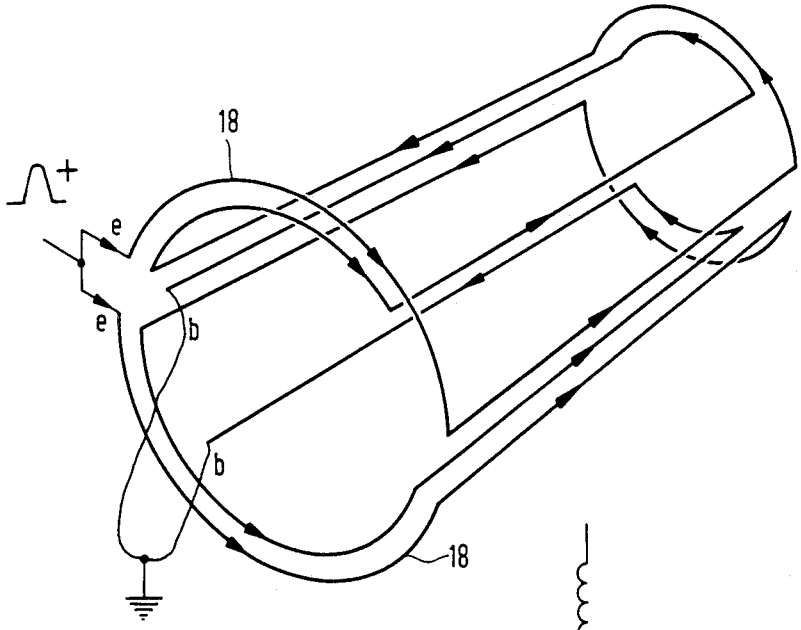
FIG. 4*a* shows a winding diagram for the system of line deflection coils of the deflection unit of FIG. 1

In FIG. 4*a* the points e are at the highest voltage and the points b are at the lowest voltage (earth in this case).

By winding the halves of line coil 18 in an opposite sense (FIG. 4A) and connecting them in parallel, there is no voltage difference between the two coil halves. The line coil spacer, or line peg (23 in FIG. 2), can then be dispensed with. In other words, adjacent turns of the line coil halves may run through the same grooves of the intermediate ring at their plane of separation.

Figure 4B:
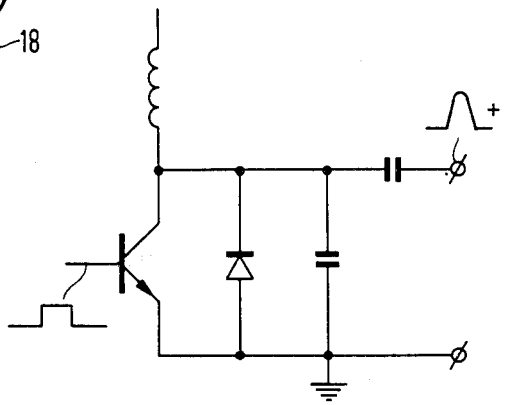
FIG. 4*b* shows the associated connection diagram.
Figure 5:
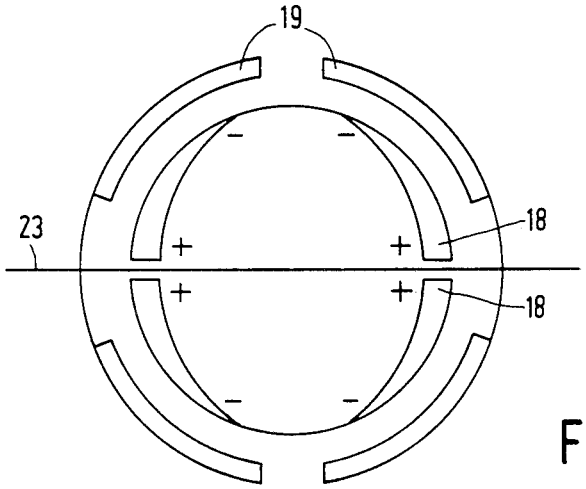
FIG. 5 is a diagrammatical cross-section through the coil systems of the deflection unit of FIG. 1

If it is also ensured that the winding sense is such that the "hot" side (+ in the drawing) is around the (possibly imaginary) line peg 23, there will have been a voltage division before the field deflection coil 19 is reached (see FIG. 5). The + connection of the line deflection coil system may then be connected to the flyback voltage and the − connection may be connected to earth (FIG. 4*b*). Ringing between the line and the field deflection coil is reduced by: the lower voltage between the line and field deflection coils as a result of the voltage division in the line deflection coil; a reduction of the capacitance (by a reduction of the contact surface) between the line deflection coil 18 and the field deflection coil 19 by deliberately keeping the field deflection coil turns far remote from the line peg (See FIG. 5).

The above-described measures, namely:

opposite sense winding of the halves of line deflection coil 18;

selecting the correct winding sense in connection with the "hot" side;

keeping the turns of the field deflection coil 19 remote from the line peg 23 in connection with the voltage division;

are also of great importance for the present yoke winding technique if no or only an extremely thin insulation can be used between the line and field deflection coil turns in connection with the dimensioning of this insulating layer with the aid of corona. Breakdown problems can be reduced in an effective manner by using the said measures.

What is claimed is:

1. An electromagnetic deflection unit for a cathode ray tube, comprising:

a longitudinally extending hollow annular support having a constricted end, a wide end, and a longitudinal axis;

a flange at the constricted end and a flange at the wide end of said support, each flange having at least one tangential groove and a multitude of substantially radial grooves merging into a said tangential groove;

a set of line deflection coils for deflection of an electron beam in a line direction at right angles to the longitudinal axis, such set comprising a pair of diametrically opposite coils with respect to said axis which are directly wound on the inside of the support and whose turns each run through a tangential groove and through radial grooves in the flanges;

a set of field deflection coils for deflection of an electron beam in a field direction at right angles to both the longitudinal axis and the line direction, such set comprising a pair of diametrically opposite coils with respect to said axis which are directly wound on the inside of the support and whose turns each run through radial grooves in the flanges;

the two line deflection coils being on opposite sides of a plane of separation therebetween and each having turns adjacent such plane and turns most remote from such plane;

characterized in that the two line deflection coils, viewed in flared-out form, are wound in mutually opposite winding senses, and are each so connected to an energizing source that the highest potential on each line deflection coil is at the turns thereof adjacent said plane of separation and the lowest potential is at the turns thereof most remote from said plane of separation.

2. A deflection unit as claimed in claim 1, wherein longitudinal portions of each of the field deflection coils are remote from the plane of separation between the line deflection coils.

3. A deflection unit as claimed in claim 2, further comprising a coaxial intermediate ring located at the plane of separation between the pair of line deflection coils and having grooves therein, turns of each of such coils which are adjacent turns of the other of such coils being in the same grooves in such intermediate ring.

* * * * *